US008152013B2

(12) United States Patent
Hendricks

(10) Patent No.: US 8,152,013 B2
(45) Date of Patent: Apr. 10, 2012

(54) UNIVERSAL MOUNTING BLOCK SYSTEM

(75) Inventor: Robert Hendricks, Youngstown, OH (US)

(73) Assignee: Tapco International Corporation, Wixom, MI (US)

( * ) Notice: Subject to any disclaimer, the term of this patent is extended or adjusted under 35 U.S.C. 154(b) by 1178 days.

(21) Appl. No.: 11/981,173

(22) Filed: Oct. 31, 2007

(65) Prior Publication Data

US 2008/0168722 A1 Jul. 17, 2008

Related U.S. Application Data

(63) Continuation-in-part of application No. 11/482,521, filed on Jul. 7, 2006, which is a continuation-in-part of application No. 10/435,258, filed on May 9, 2003, now Pat. No. 7,510,153.

(51) Int. Cl.
*H02G 3/08* (2006.01)
*B65D 6/28* (2006.01)
*H01R 13/502* (2006.01)

(52) U.S. Cl. ..... 220/3.8; 220/4.02; 174/562

(58) Field of Classification Search ..... *B65D 6/28,8/18*
See application file for complete search history.

(56) References Cited

U.S. PATENT DOCUMENTS

| | | | | |
|---|---|---|---|---|
| 2,752,844 | A * | 7/1956 | Simblest | 454/277 |
| 2,924,639 | A * | 2/1960 | Zelt | 174/59 |
| 4,794,207 | A * | 12/1988 | Norberg et al. | 174/505 |
| 4,922,673 | A * | 5/1990 | Ishii et al. | 52/220.1 |
| 2004/0055774 | A1 * | 3/2004 | Vagedes | 174/58 |
| 2004/0099661 | A1 * | 5/2004 | Lalancette et al. | 220/3.3 |

* cited by examiner

*Primary Examiner* — Mickey Yu
*Assistant Examiner* — Robert J Hicks
(74) *Attorney, Agent, or Firm* — Quinn Law Group, PLLC

(57) ABSTRACT

A wall-mounting block or frame is used to mount fixtures to exterior building walls having siding. The wall-mounting block includes two major parts, a first or base section and a second or holding section which are both configured as cap-like structures detachably connected to each other with integrated, adjustable connectors. The present design eliminates the need for special hardware to attach the holding section to the base section, and helps prevent awkward mounting situations.

20 Claims, 12 Drawing Sheets

UNIVERSAL MOUNTING BLOCK SYSTEM

RELATED APPLICATIONS

This is a: CONTINUATION-IN-PART of U.S. patent application Ser. No. 11/482,521, filed: Jul. 7, 2006 which is a Continuation-In-Part based on U.S. Utility patent application Ser. No. 10/435,258, filed: May 9, 2003 now U.S. Pat. No. 7,510,153

FIELD OF THE INVENTION

The present invention is generally related to frames, blocks, brackets, or other structures for mounting fixtures to a wall. More particularly, the present invention is directed to a wall-mounting block that accommodates a wide variety of fixture types and sizes while easily locking over the siding of an exterior wall on which the mounting block is used.

BACKGROUND ART

Standard frame construction is used in virtually all residential and related construction in the United States, and in many other places throughout the world. This method of construction includes a wooden or steel framework of studs covered with a light sheathing of foam, light fiberboard or plywood, Celotex™, or any number of other light sheathing or substrate materials. Normally, heavy-duty fiberboard or plywood is not used throughout a frame construction due to the cost. Further, it has been found far more desirable to use a light-weight sheathing material that has some insulating or even waterproofing value. In most external wall systems some type of siding material is applied over the sheathing to provide water resistance and decorative features.

Sometimes the sheathing or substrate is of wood, and has substantial structural value. In other cases, the sheathing can be low-gauge vinyl supported by a foam backing, to obtain improved insulating properties, but having little structural value. The same types of materials can also be used for the overlying siding. In many cases, neither the siding nor the underlying sheathing is separately capable of supporting a fixture to be mounted on the exterior wall. Consequently, standard frame construction very often requires that both the sheathing and the siding be used in conjunction to support any fixtures to be added to the wall. This is especially important when apertures must be formed in both the substrate and the siding to accommodate a fixture, but which weakens the wall. If the substrate and siding can't support the fixture it must be moved so as to be supported by a stud, or other more substantial portion of the wall.

As a result, the building industry has adopted a number of mounting blocks that utilize the combined strength of both the siding and the underlying substrate or sheathing. Conventionally, this is done by having a lower mounting frame attached, around an aperture (accommodating the fixture to be mounted), and directly attached to the sheathing. A second or upper mounting frame is then connected to the already fixed lower mounting frame, which is attached to the sheathing. Finally, there is a holding piece (or pieces) which attaches either to the upper frame (fixture support) or the lower mounting frame (in some cases both), to hold the siding and to utilize the structural capability of the siding around the overall mounting block. By placing the framework around the aperture in the wall, and firmly interlocking all three of the mounting frame pieces, a moderately stable mounting support for a fixture can be effected, even on a relatively flimsy wall.

However, using conventional mounting blocks, this process has not always been easy to carry out. In many traditional arrangements, three (or more) different pieces must be fit together, along with the fixture to be supported. Consequently, the process can be extremely awkward, especially if unskilled labor is employed, or adverse conditions ensue.

Another problem, even for highly skilled workers, is the fact that conventional mounting blocks normally come in three separate pieces, often with separate connecting devices for each piece. Under the often-chaotic conditions of construction sites, pieces of the mounting blocks, especially the connectors, can be misplaced or lost. This results in delays or other difficulties, and often leads to the expedient of ordering redundant mounting blocks just to make certain that a full kit is available when needed.

This problem has been addressed in part by arrangements in which two of the three components are temporarily attached together. However, there have been difficulties with such arrangements since sometimes the attached components must be separated for one to be mounted, and then reattached to each other. This often leads to breakage.

In some arrangements, two of the components (lower frame and fixture support structure) are formed as one piece, alleviating some of the aforementioned difficulties. However, the upper holding piece which is used to hold the surrounding siding, is usually a separate piece in conventional mounting block designs. Otherwise, it would be very difficult to position and connect the holding piece to the wall using conventional mounting blocks. Unfortunately, this upper holding piece can be lost. In some cases, even if the upper holding piece is not lost, its connectors can be, thereby compromising the overall mounting block.

This drawback has been addressed in U.S. patent application Ser. No. 10/435,258, filed May 9, 2003, by the same inventor and incorporated herein by reference. In this arrangement, the pieces used for holding the siding are attached to a cap-like structure support that is used to support the fixture and has mounting flanges to attach to the substrate or underlayment of the wall. This mounting block is used by cutting away the siding around the aperture through which the fixture will pass through the substrate of the wall. The holding structures are arranged as two rotate able pieces that are permanently attached to the rest of the mounting block. When the mounting block is put in place, the holding pieces rotate opposite each other over the surrounding siding. The subject mounting block is easy to handle and to install. The rotating holding pieces provide a convenient handle for shifting and positioning the entire mounting block. The rotating holding pieces can lock into place around the support structure of the mounting block. The permanent attachment keeps the holding pieces from being lost, or otherwise separated from the rest of the mounting block.

While the overall structure and operation of the aforementioned subject mounting block is generally superior in all respects, there are some disadvantages that have been discovered. Under normal, expected usage, the plastic hinges of the subject mounting block are not at risk. However, as is so often the case on a construction site, abuse can occur and the hinges can break. Likewise, the connections between the rotating holding pieces and the rest of the mounting block can also be broken, creating a separation that might be very difficult to repair. Even if repair is possible, there is the possibility of water working its way past the water tight seals of the mounting block and into the vulnerable, underlying wall.

There are other drawbacks to this design. For example, the plastic hinges can be warped by heat, like any plastic mounting block. Further, the rotation of the holding pieced does not permit an optimum fit for locking purposes, even though some variation of siding thicknesses can be accommodated for this particular design. As with any plastic design, general warping of the overall structure of the mounting block may lead to the intrusion of water at various points through and around the mounting block. Also, as is the case at any construction site, less than precise measurements may result in situations that cannot be accommodated by a particular mounting block. This would result in a questionable connection the mounting block and the building, compromising both the fixture and the surrounding siding.

Another major drawback of the conventional mounting block art is that a wide range of different fixtures must be accommodated. It has become standard use in the construction industry that different types of fixtures require different sizes and types of mounting blocks. Consequently, a wide range of drilling patterns and parts are necessary. On large construction sites with substantial numbers of different mounting blocks, the complexity associated with multiple installations of different types of blocks can become so great as to be debilitating. This is especially true when parts for different fixture sizes and types bear a close resemblance to each other.

A further drawback with much of the conventional mounting block art is that very often substantial numbers of parts are involved in the mounting of each fixture (for example: fixture, decorative cover plate, mounting block base, electrical box, siding flange and/or multiple cover plates for the electrical box and mounting block). These multiple parts require multiple connections to each other so that there is very often a chain of connections, some of which may not be particularly secure. As a result, even if the installation takes places properly, the overall assembly may not be particularly secure. This can be both expensive and dangerous with electrical fixtures.

Accordingly, there is a substantial need for an improved wall-mounting block that overcomes the difficulties of the conventional mounting blocks. In particular, such an improved mounting block would alleviate the problems of lost parts, and facilitate easy installation. Also, an improved mounting block would provide for varying thicknesses of siding and sheathing while maintaining substantial resistance to water intrusion. The improved mounting block system would limit the number of different parts required, and would provide for very stable connections to secure the fixture being mounted to the block. This is especially important when mounting electrical fixtures in conjunction with electrical boxes.

SUMMARY OF THE INVENTION

Accordingly, it is one object of the present invention to overcome the deficiencies of the conventional art.

It is another object of the present invention to simplify the installation of fixtures on frame walls, and other structures in which an aperture is used to accommodate the fixture.

It is a further object of the present invention to provide a wall-mounting block that is easily adjustable for a wide range of wall and siding thicknesses.

It is an additional object of the present invention to provide a wall-mounting block which is configured to avoid the loss of critical parts.

It is still another object of the present invention to provide a wall-mounting block that is more easily installed than conventional mounting blocks.

It is yet a further object of the present invention to provide a wall-mounting block that has the capability of utilizing all structural aspects of a wall to maintain a secure support for a fixture.

It is again an additional object of the present invention to provide a wall-mounting block having integral parts to facilitate handling of the mounting block during the mounting process.

It is still another object of the present invention to provide a wall-mounting block that is formed to be extremely robust.

It is again a further object of the present invention to provide a mounting block for wall vents and gable vents of varying sizes and shapes.

It is yet an additional object of the present invention to provide a mounting block for a wide variety of fixture types.

It is still another object of the present invention to provide a wall mounting block capable of superior structural strength over that of conventional mounting blocks, so that heavier fixtures can be safely mounted that is possible with many conventional designs.

It is again a further object of the present invention to provide a mounting block that is more highly resistant to water intrusion than many conventional mounting blocks.

It is yet an additional object of the present invention to provide a mounting block capable of uniform, reliable locking or latching over a wide range of siding thicknesses.

It is still another object of the present invention to provide a wall mounting block that is more highly resistant to warping and misalignment than conventional mounting blocks.

It is again a further object of the present invention to provide a wall mounting block system in which a common base can accommodate a wide range of different sizes and configurations of upper pieces that interface with the fixture to be mounted.

It is yet an additional object of the present invention to provide a mounting block system having a virtually infinite range of adjustments to accommodate various siding sizes.

It is still another object of the present invention to provide a mounting block system that accommodates adjustments of positions in an associated electrical box.

It is again a further object of the present invention to provide a mounting block system to accommodate a water spigot with a base unit that is common with arrangements for accommodating other types of fixtures.

It is yet an additional object of the present invention to provide a mounting block system which provides superior interconnection between all parts of the mounting block system and the fixture mounted thereon.

These and other goals and objects of the present invention are achieved by a mounting block system, arranged to hold a fixture to a wall having a substrate and siding arranged over that substrate. A first section is a common base section having at least one integrally formed mounting flange arranged to be positioned against the substrate. The common base section is formed as a support structure including side walls extending perpendicularly from the mounting flange to a integrally formed upper interface. The upper interface includes a plurality of integrally formed connector receivers in a common configuration. The second section is an upper cap arranged to fit over the common base and has integrally formed contiguous side walls supporting perpendicularly extending, integrally formed holding flanges, and an upper support surface arranged to fit over the common base section. The upper cap has downwardly extending connecting prongs in the standard configuration corresponding to the plurality of connector receivers in the common base section, wherein the common base section is configured to interface with a plurality of upper caps of different sizes and configurations and having the common configuration of connectors.

DETAILED DESCRIPTION OF THE PREFERRED EMBODIMENTS

Figure 1:
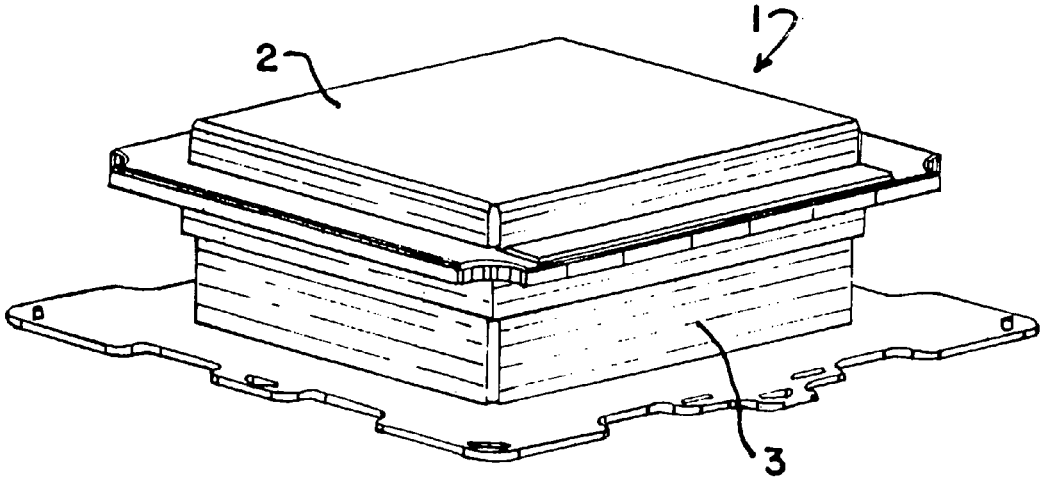
FIG. 1 is a side perspective view of the assembled wall-mounting block serving as the basis of the present invention.
Figure 2:
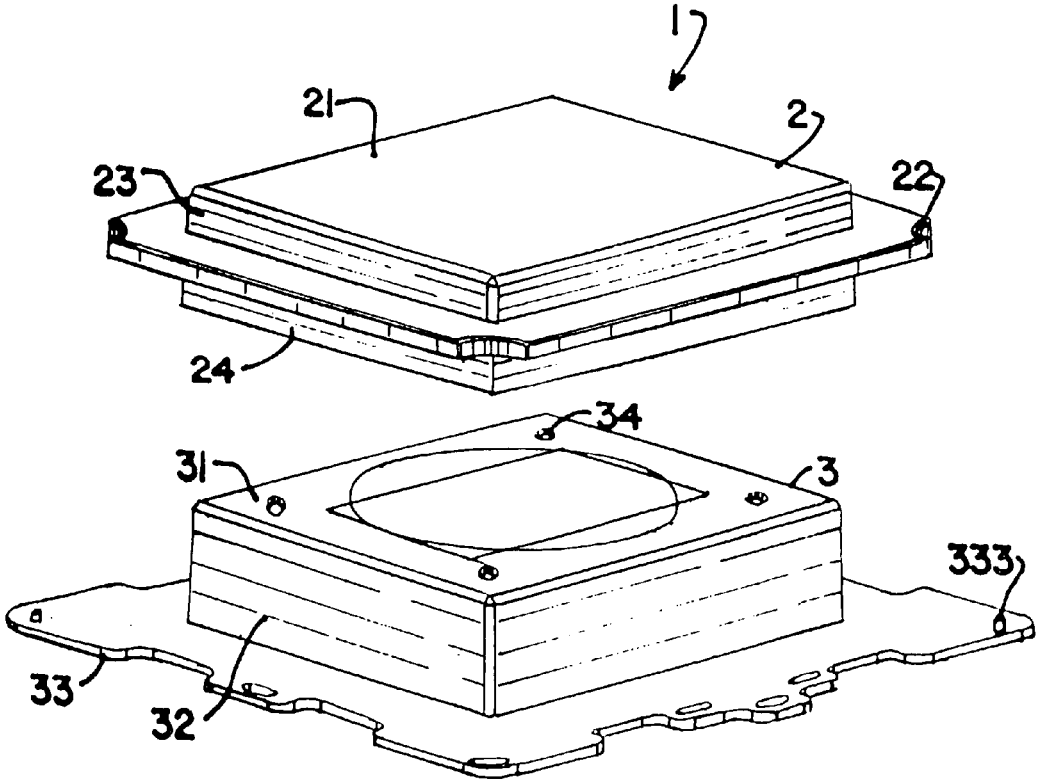
FIG. 2 is a side perspective view of the wall-mounting block of the present invention, with two mounting block sections depicted separately.
Figure 3:
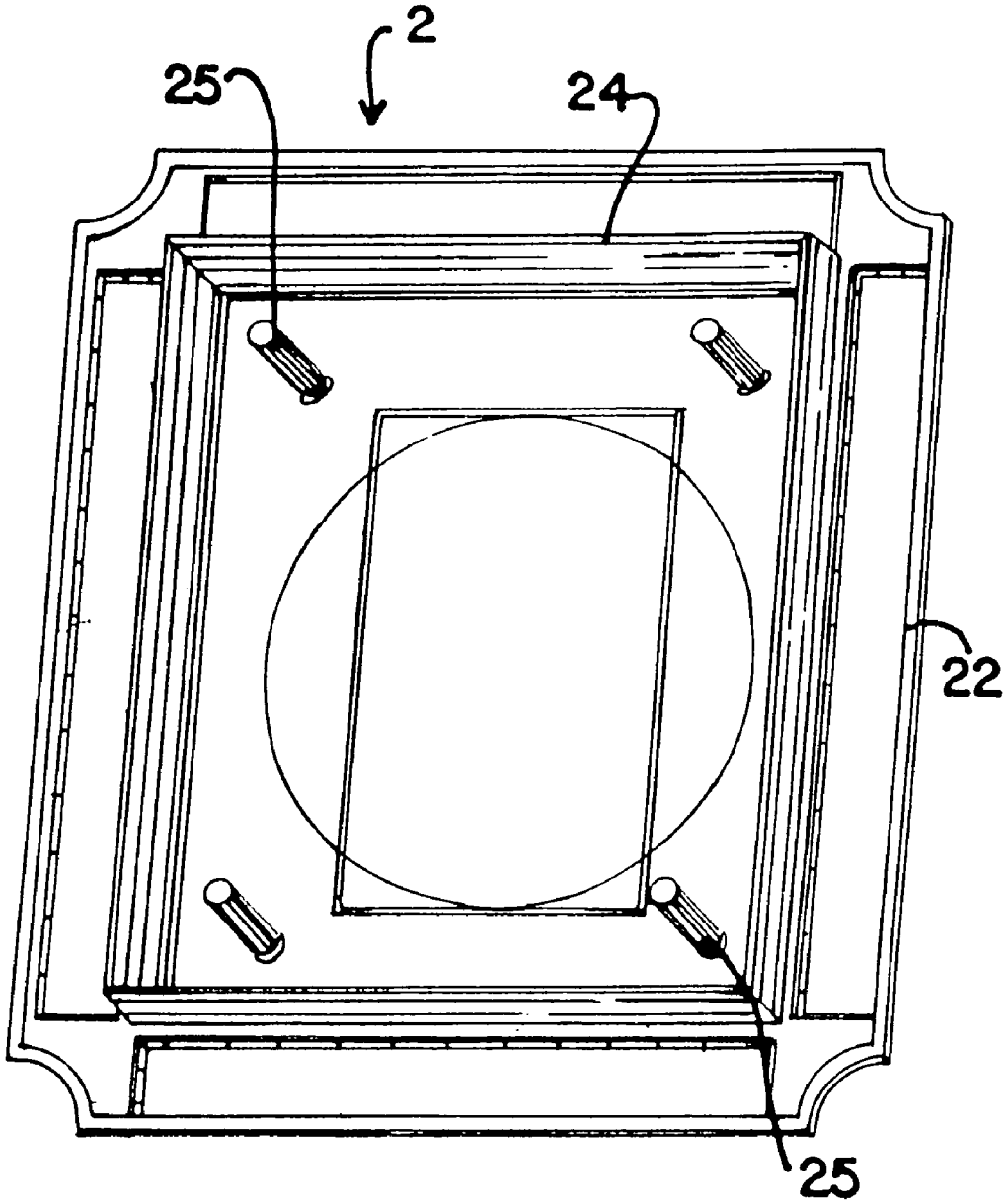
FIG. 3 is a bottom perspective view of the upper section of the wall-mounting block of the present invention.
Figure 4:
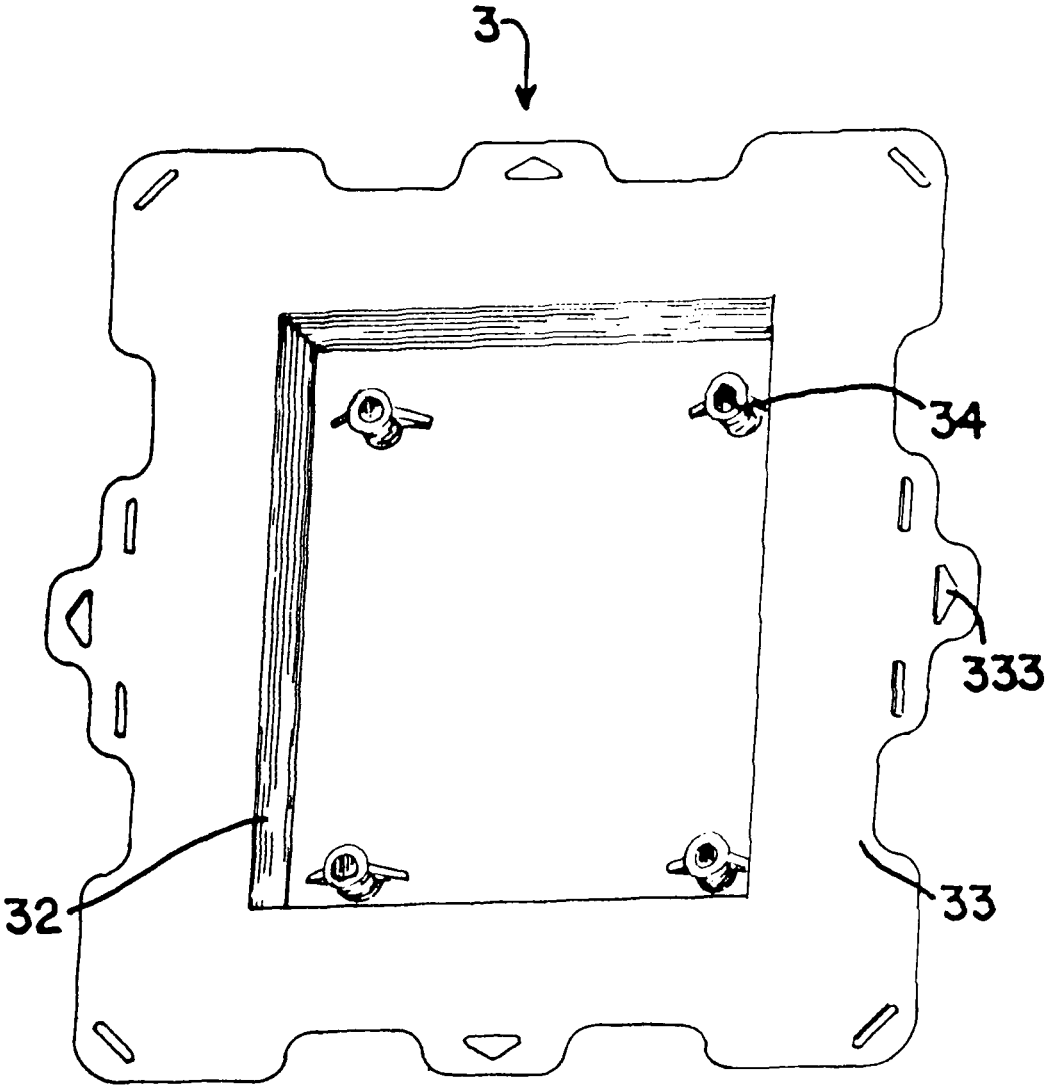
FIG. 4 is a bottom perspective view of the lower section of the wall-mounting block of the present invention.

The universal wall-mounting block system 1 of the present invention is depicted in FIGS. 1-4, it its most basic form. The wall-mounting block system of the present invention is meant in a first preferred embodiment to be mounted around an aperture in a wooden frame wall of standard construction (with siding). However, the aperture is not necessary for the proper operation of the present invention, which can be mounted around a fixture such as a water spigot. It is the fixture that dictates the characteristics of the aperture, and some of the characteristics of the mounting block system 1.

One strength of the universal wall-mounting block 1 of the present invention is that it is effective even on walls constituted by flimsy materials. The present invention facilitates use with (or without) an aperture in almost any type of structural material. This can include anything from plastic foam to steel. Preferably the wall structure will have some sort of siding to help facilitate the locking of the overall arrangement to the wall, thereby making use of all the benefits of the present invention.

In most of its embodiments, the present invention is constituted by two self-contained sections 2, 3, with no other parts. Manufacturing can be done by injection or spin molding to form each section 2, 3. Both the upper holding section 2, and the lower or base section 3 are very similar to each other in both size and overall construction. Both share a cap-like configuration. Additional parts are usually not necessary since the connectors are entirely self contained within each of the two sections.

In most embodiments of the present invention, the use of only a two piece mounting block provides many of the benefits of the present invention. In particular, crucial connecting parts cannot be lost since they are non-detachably formed as part of each sections 2, 3. This is a critical feature since at most construction sites, chaotic conditions ensue, and it is very common for parts from a box to become separated or lost, especially if many mounting blocks are being used.

In the FIG. 1 depiction, the wall-mounting block 1 is in an installed position as it would be configured after being attached to wall substrate 100 and after the upper or holding section 2 is locked down over the siding (not shown), which itself is permanently connected to wall substrate 100. It should be noted that the mounting flanges 33, which are part of the base or first section 3, are meant to slide under the siding (not shown) as part of the overall installation. It should be understood that pieces of the siding must be removed to accommodate mounting block 1 which is meant to fit over an aperture (not shown) in the wall substrate 100 to accommodate the fixture (not shown).

The wall substrate 100 is usually standard building sheathing, that can be constituted by a number of different materials. The siding is likewise standard material, usually, wood, vinyl, or aluminum. However, other materials can be used for the sheathing or siding with the present invention.

The lower or base section 3 has an upper surface 31, which is used to help protect the vulnerable hole in substrate 100, and is sometimes used to interface with mounting surface 21 of upper or holding piece 2. The mostly solid surface 31 provides structural support to help hold the fixture (not shown). Normally fixtures have parts (such as wiring) passing through an aperture in the wall substrate 100. The entire wall-mounting block 1 is meant to fit around the exterior of an aperture in both siding and substrate 100. Accordingly, both mounting surface 21 and upper surface 31, must accommodate apertures.

Upper surface 31 can be provided with a number of different holes, drilling arrangements, or scribing patterns 35 to facilitate easy passage therethrough of the fixture parts (not shown). Surface 31 is supported by support structure 32, constituted by four sidewalls extending around the base section 3 to form a cap-like structure that can be easily drilled without structural compromise. It should be noted that the drilling patterns for both support surface 21 and upper surface 31 will be different in most applications. This is because surface 21 must hold all the connectors for the fixture while upper surface 31 must merely provide for passage of wires, cable, conduits or the like. Drilling patterns are almost always a matter for the installer, and thus, are extremely difficult to predict at the point of manufacture. Drilling and scribing patterns depicted in the attached drawings are merely examples of possible drilling and scribing arrangements.

In one preferred embodiment, the sidewalls of support structure 32 are of a single height. However, this is not always the case. Rather, the sidewalls can be of a telescoping structure to accommodate different sizes of siding or different requirement of the fixtures (not shown) to be mounted on mounting block 1. This is true for any other embodiments of the present invention described Infra.

During the installation of the base section 3, mounting flanges 33 are slipped beneath siding pieces (not shown). Any different number of or size of connecting holes 333, or configuration of those holes can be used to accommodate connectors to hold mounting flanges to substrate 100. Mounting holes can be configured for a particular type of substrate 100 and a particular type of connector (not shown) to be used. Of particular interest is the fact that mounting flange 33 extends well beyond holding flange 22 of the upper or holding section 2. This arrangement provides a much larger footprint and thus more stable connection to the wall substrate 100. It also provides flexibility in that part of the mounting flange 33 can be cut or eliminated to help facilitate the installation of mounting block 1.

Fastening can be done by means of wood screws, nails, brads, staples or adhesives. If wall substrate 100 is plastic, ultrasonic welding can be used. If wall substrate 100 is metallic, appropriate means, such as machine screws, can be used for attaching the plastic mounting flange 33 to the metallic skin of wall substrate 100. Rivets could also facilitate the mounting. Even glue can be used to hold the mounting flange 33 to the wall substrate 100.

It should be understood that the thickness of mounting flange 33 is not limited to any specific value. Rather, this can be made thicker or thinner in the manufacturing process to facilitate connection to a particular type of wall substrate 100. Also, the other parts of the wall-mounting block 1 can be modified to any size that is appropriate for a particular environment or application. The wall-mounting block 1 is preferably made of plastic using an injection-molding process, but other processes can be used. Likewise, any number of different materials can be used, including: nylon, rubber, wood or metal.

A key attribute of the present invention resides in the contiguous support structure (32, 23-24, respectively) of each section 2, 3. These are constituted by the side walls and the upper surfaces of both the lower base section 3 and the upper holding section 2. The side walls of both sections are contiguous with each other and with the upper surfaces of each section. The side walls of each section are also contiguous with their respective mounting flanges 33 and holding flanges 22. This results in cap-like contiguous structures that are very stable and resist warping. As a result, water migration is severely curtailed due to a lack of openings in the overall structure constituted when the two sections 2, 3 are combined as depicted in FIG. 1.

The rigid side wall structures of the upper holding section 2 are divided into two sections, upper 23 and lower 24. These are divided by the holding flange 22 which extends over the siding (not shown), holding it in place. The side walls 23, 24 fit closely over the side walls 32 of the lower or base section 3. Because both cap-like structures are relatively rigid, a close fit is easily effected. The close fit and contiguous nature of both sections 2, 3, provide for a substantial resistance to the migration of water or other fluids. Also, because the side walls of the base section 3 are contiguous with the mounting flange 33, opportunity for the migration of moisture is further limited. Likewise, the fact that the holding flanges 22 are contiguous with the side walls 23, 24 of the holding section 2 also eliminated another possible route of migration.

The two upper surfaces, interface surface 31 and mounting surface 21 of the two sections 2, 3, respectively are constituted by essentially solid structures, contiguous with their respective side walls (32, 23-24). This arrangement provides not only proof against migration of moisture but also a very stable structure to support the fixture to be placed on the mounting block 1. Because of the stability of the mounting block, sufficient structural support exists to allow the use of extensive hole and aperture patterns. Both of the upper surfaces 21, 31 have sufficient structural stability to support a wide variety of different drilling patterns.

Likewise, either of the upper surfaces 21, 31 can independently support the fixture to be arranged on the mounting block 1. For the upper surface 31 to support the fixture (not shown), all that need be done is to form an aperture in mounting surface 21 sufficiently large to accommodate the fixture. This leads to a much higher level of versatility when dealing with unusual fixture sizes and shapes, or other mounting requirements.

A great deal of the installation flexibility enjoyed by the present invention resides in the nature of its connecting arrangement. In one embodiment of the present invention the upper holding section 2 has four connecting prongs, 25 oriented downward from mounting surface 21. These are preferably formed entirely as part of holding section 2, and are configured with rough or ribbed surfaces so as to effect a friction fit with connector recesses 34 on base section 3.

Base section 3 includes four complementary recesses 34 positioned to interface with the connecting prongs 25 of holding section 2. The interior of these recesses are contoured so as to interact with the exterior of connecting prongs 25 in order to create a friction fit connection. The friction fit permits a secure connection between the two pieces 2, 3 over a wide range of distances from each other. Because the connector recesses 34 are open ended, the connector prongs 25 can pass entirely therethrough when accommodating thinner sidings. Further, because the friction connection operates with very little length of connector prongs 25 within the connector recesses 34 substantial thicknesses of siding can also be accommodated. This increases the range of thicknesses of siding that can be accommodating by the mounting block 1 of the present invention.

Preferably, there are four sets of connectors (25, 34) located at each corner of mounting block 1. Because easily adjustable friction connectors are involved, continuous (also known as infinite) adjustment over most of the entire length of the connectors is easily facilitated. Further, adjustment takes place over the entire periphery of the mounting block 1 in a uniform manner. There is no rotational movement necessary as is common in many conventional mounting block systems.

The smooth, uniform adjustment of the two sections (2, 3) of the mounting block 1 is also facilitated by the cap-like structures that closely fit over each other. Not only is the resulting structure easy to install (even in unskilled hands), it is also very robust and resistant to entry of moisture in most places.

If special thicknesses must be accommodated it is relatively simple to add extensions to connecting prongs 25. This can be done in the molding process by welding plastic extensions or any other technique that would serve to extend the connecting prongs within the known plastic molding technology. Overly-long connecting prongs 25 can be trimmed to a desired length.

The connecting prongs 25 and receivers 34 are crucial to the concept of establishing a common base unit 3. In order for this occur, the same spacing for receivers 34 must be maintained on each base unit. Further, the receivers must have the same diameter so as to receive the same type of prong 25. In the preferred embodiment, there are four connecting prongs 25 (in the upper holding piece) corresponding to each of the receivers 34 in the base unit. However, a different configuration of prongs and receivers could be used. All that matters is that the same configuration be used for each base unit and for each of the upper holding units, regardless of the fixture or function or size of the upper holding unit 2. By maintaining the same configuration of connecting prongs 25 and receivers 34, a wide variety of different upper holding section sizes can be used with the same base unit. The use of a common base unit greatly simplifies the situation at construction sites, especially when a wide variety of different fixture sizes and types are to be used (thereby entailing a wide variety of different upper holding sections 2, sizes and configurations).

Figure 5:
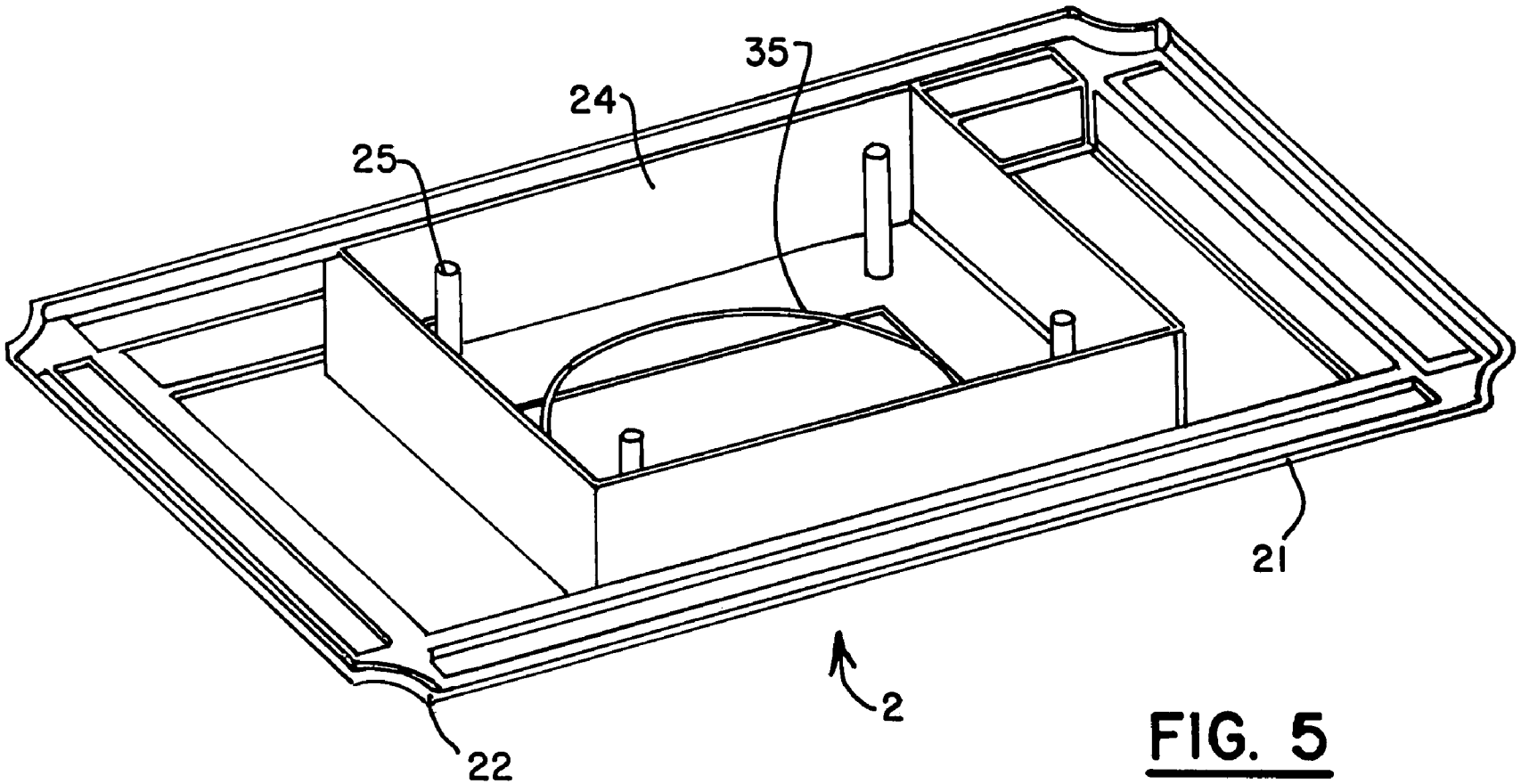
FIG. 5 is a bottom perspective view an upper cap with an extended mounting surface.
Figure 6:
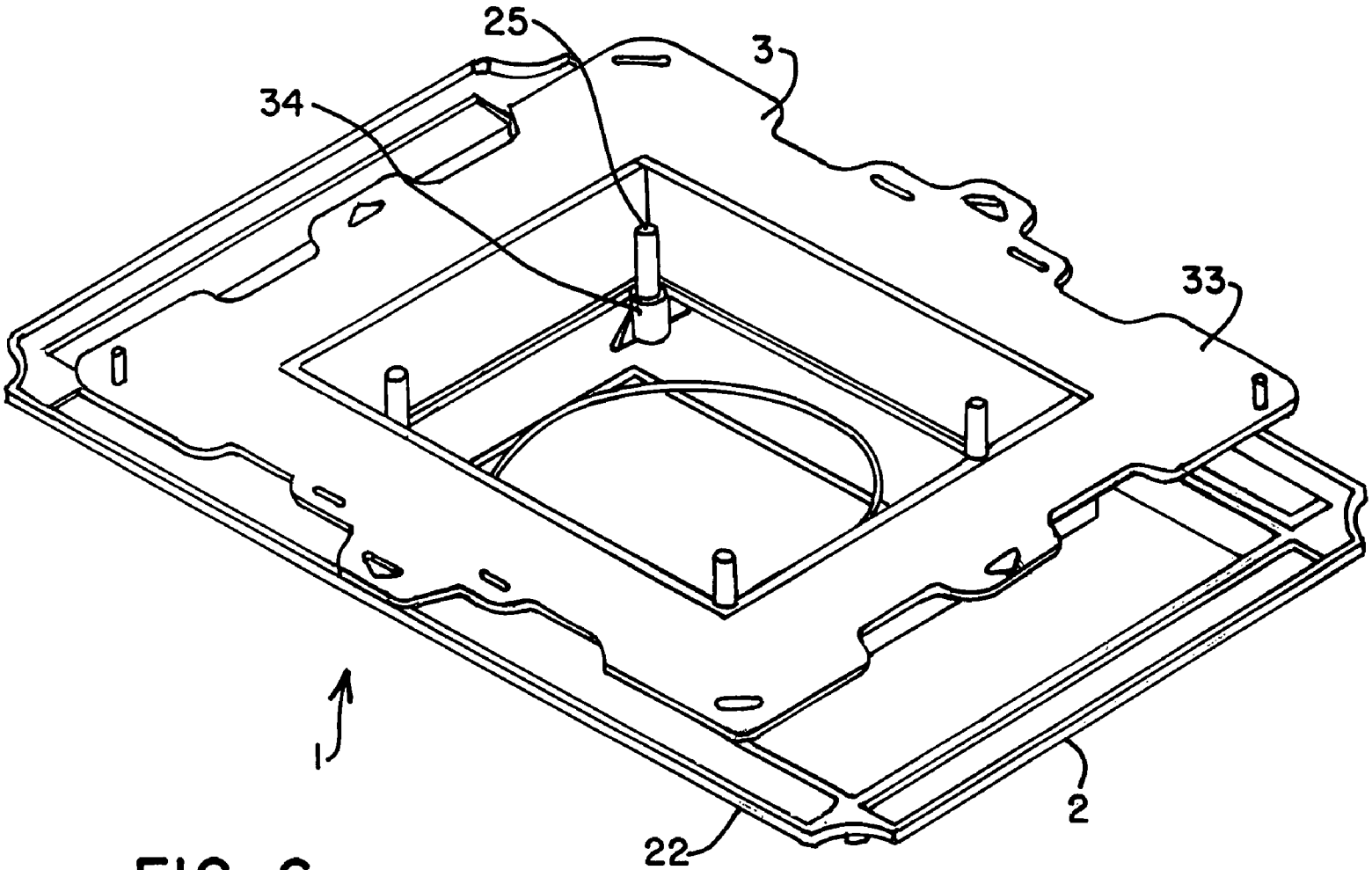
FIG. 6 is a bottom perspective view of both parts connected together in accordance with the present invention.

One example is depicted in FIGS. 5 and 6. The subject is an upper cap or holding piece 2 that has a much larger mounting surface 21 than can be accommodated by the standard sized mounting block. This oversized mounting surface 21 is usually required to accommodate a much larger fixture than would otherwise fit on a standard sized mounting block and would normally require a larger base unit. However, the base unit is of a standard size and connector arrangement. The side walls 24 are sized for a standard sized base unit 3. This arrangement of the present invention avoids conventional size limitations.

FIG. 6 depicts an assembled mounting block 1 wherein a standard base unit 3 has been connected with an oversized upper holding unit 2. Normally, the nailing flange 33 has a much greater footprint than the upper holding unit, even with the holding flange 22. However, in this particular embodiment, the upper holding unit 2 may be so sized as to provide dimensions even greater than that of the nailing flange 33. The key to accommodating a much larger upper holding piece 2 than normal is the standard configuration of the connecting prongs 25 and the receivers 34. Likewise, the peripheral walls 23-24 for the upper holding piece 2 also remain the same size so as to provide a close fit with the peripheral walls 32 of the standard base unit 3. This provides structural stability even if the upper mounting surface 21 is substantially larger than the footprint of the standard base unit 3. The use of common base units for a variety of upper holding piece sizes and configurations greatly simplifies the situation at a construction site where many different mounting block arrangements have to be used to accommodate a wide range of fixtures.

Figure 7:
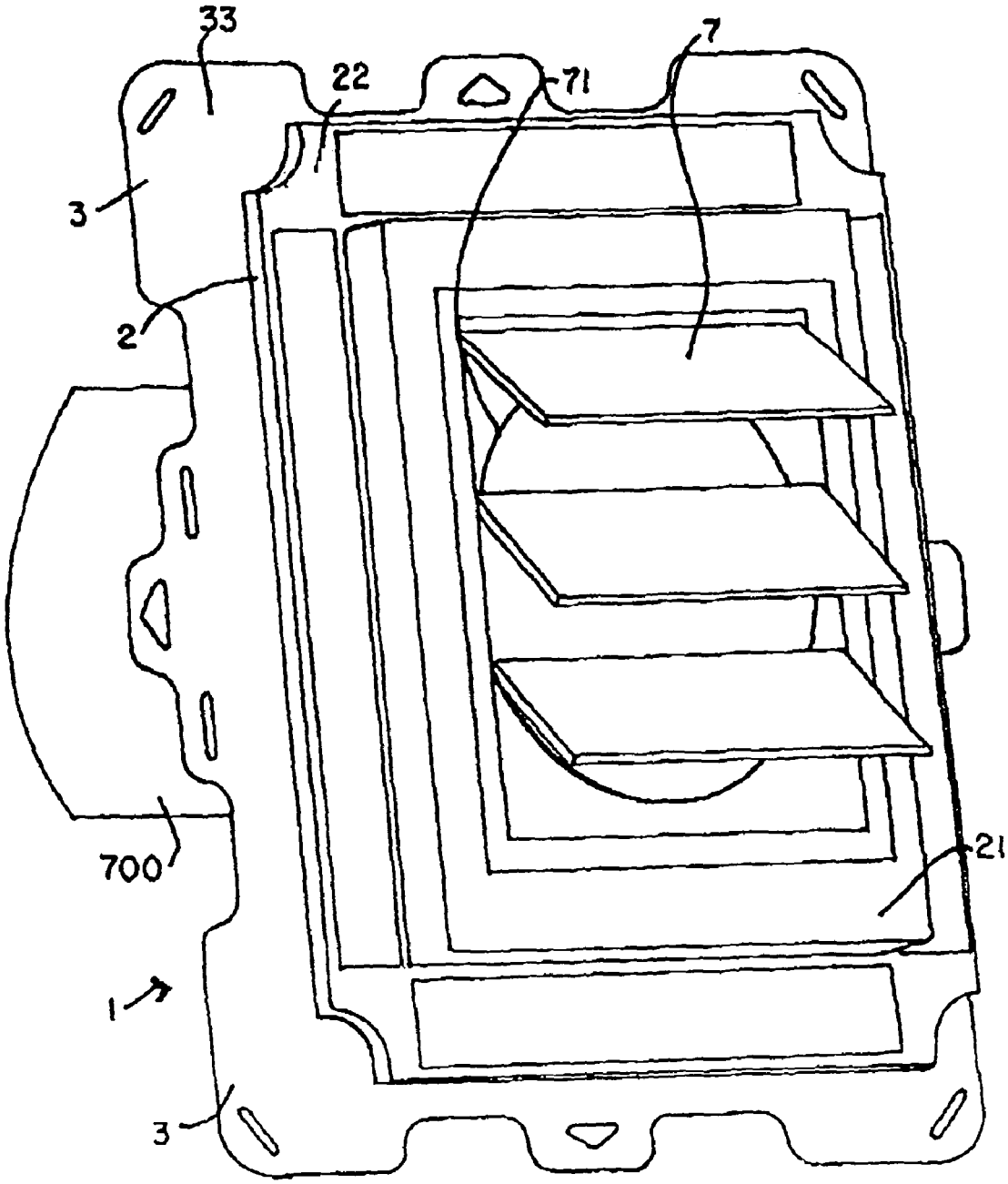
FIG. 7 is a top perspective view of a vent configuration in accordance with the present invention.

The use of a standard base unit 3 permits not only larger sizes, but different configurations for the cap or upper holding piece 2. This is especially relevant for gable vents and dryer vents which have always been problematical with the convention art. FIG. 7 depicts a dryer vent used within the concept of the present invention. The upper holding piece 2 is the same as a normal piece except that a hole has been drilled into mounting surface 21 and a vent piece 7 mounted thereon. The vent piece 7 entirely covers the hole 71 with a series of hinged louvers. Hole 71 can be of any configuration that is suitable for the tube 700 which leads from the dryer to the mounting block 1. It is to be understood that any shape and most sizes of tubing 700 can be accommodated with the present invention, by making appropriate cuts in surfaces 21, 31.

Since neither of surfaces 21, 31 need be predrilled, the drilling can be customized to the particular situation where the mounting block 1 is to be installed. It should also be noted that any kind of configuration of vent or louver can be substituted for 7. This is easily accommodated by use of an oversized upper holding piece 2, modified as needed. An example of a mounting procedure is found in Appendix I, attached hereto and incorporated herein by reference.

While the examples depicted in the drawings have been square in shape, the present invention is not limited to this configuration. Rather, the shape of the mounting block 1 can be circular, half-circular, trapezoidal, or even triangular. Further, rather than providing a mounting surface for a fixture, the entire mounting frame can encompass the fixture. An example could be gable vents. The use of the present invention in such an embodiment would greatly simplify the mounting of gable vents, which can be somewhat problematic using conventional methods. A key benefit is that a wide range of fixtures can be accommodated using the common base of the present invention.

Figure 8:
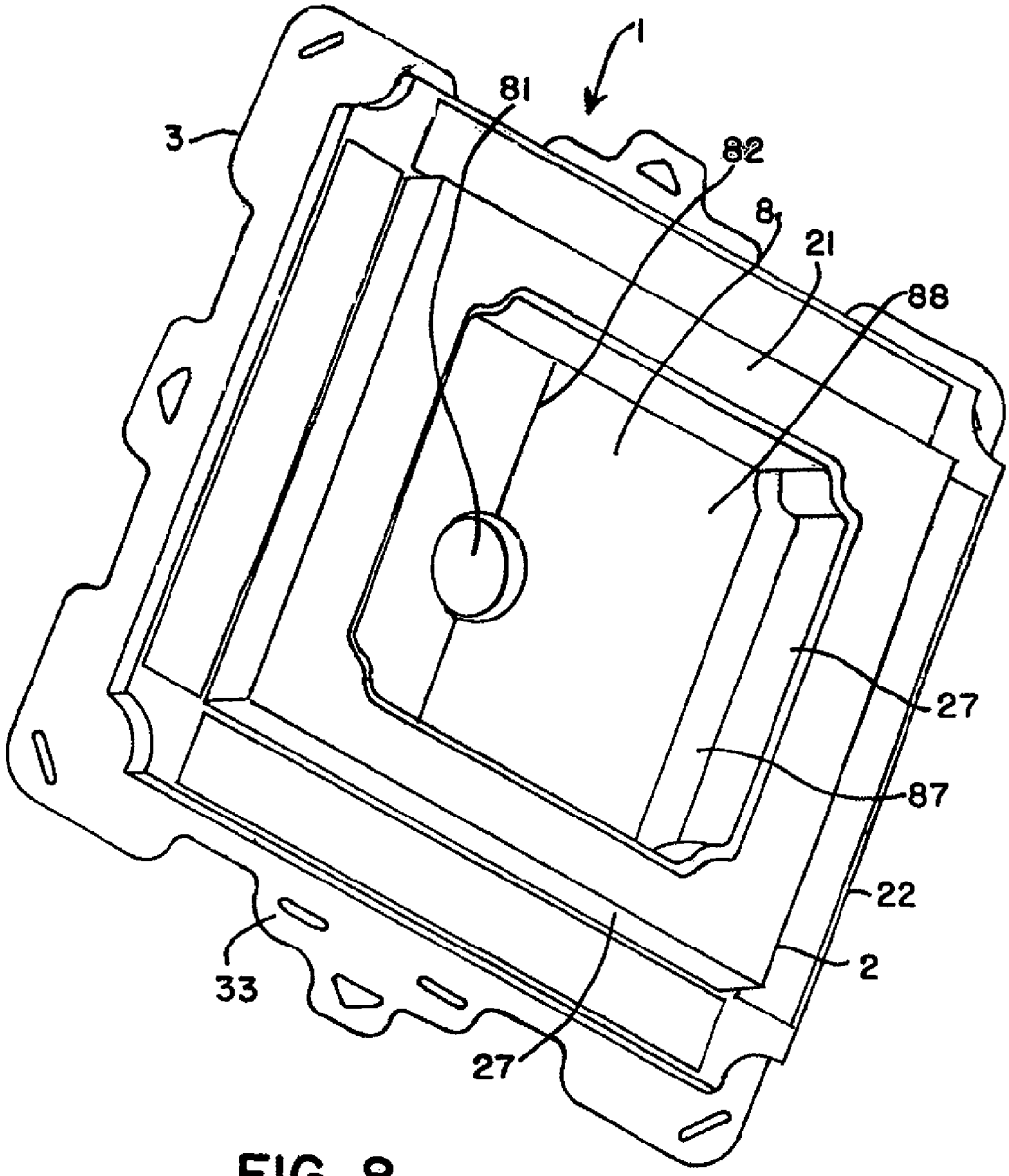
FIG. 8 is a top perspective view of an arrangement to be used with a water spigot in accordance with the present invention.

Another embodiment of the present invention is depicted in FIG. 8, which is an arrangement for a water spigot. This embodiment requires a modification to the common base 3. In particular, most or all of the upper surface 31 is removed so that tray 8 can be inserted in place of surface 31. Tray 8 is formed as two split pieces that are overlapped and interface 81. Aperture 82 is formed to fit around a water spigot. Preferably, tray 8 includes side walls 87 as well as a bottom 88. The side walls can have J-shaped lips (shown in Appendix II) at the top to better interface with peripheral walls 32 of base 3.

In the corners of tray 8 are receivers 34 to accept connecting prongs 25. These are formed as part of the interior corners of tray 8 and follow the standard configuration for connectors so that the tray is sized and configured just as a the connecting arrangement for any common base unit 3.

This particular embodiment also requires a modification to the upper holding piece 2. In order to obtain access to the spigot (which protrudes through aperture 81), it is necessary to remove most of upper mounting surface 21. This is appropriate since there is now nothing mounted on this surface, the spigot already being held within tray 8. However, part of upper mounting surface 21 remains in order to support connecting prongs 25. These are formed at the standard spacings required for the common base unit 3.

In order to maintain a more rigid structure, there is a contiguous inner wall 27 formed downward from mounting surface 21. This wall is formed on all four sides of the upper holding piece 2. Inner wall 27 is also sized as to provide a tight, friction fit against the side walls 87. This friction fit further strengthens the overall structure and is especially valuable because of the stresses placed on mounting block 1 when operating the spigot (not shown).

Appendix II, attached hereto and incorporated by reference, contains a instruction sequence for assembling the embodiment of FIG. 8. While not necessary for a full understanding of the present invention, these instructions may help illustrate some of the advantages of the present invention over the conventional art.

FIGS. 9-13 depict another embodiment of the present invention, directed to a combination electrical box 9 and mounting block 1. As with the other embodiments of the present invention, a standard spacing and configuration of the connection arrangement is used along with a common base unit 3. This embodiment addresses some of the problems of adjusting an electrical box with respect to the mounting block and provides multiple levels of adjustability between the two, while maintaining a stable platform for the fixture to be mounted.

Electrical box 9 has connecting flanges 91 with apertures 92. These apertures are designed to receive connectors 25 from the upper holding piece 2. It is noted that the spacing and the arrangement of the connector apertures 92 conform to that of the common base unit 3.

Figure 9:
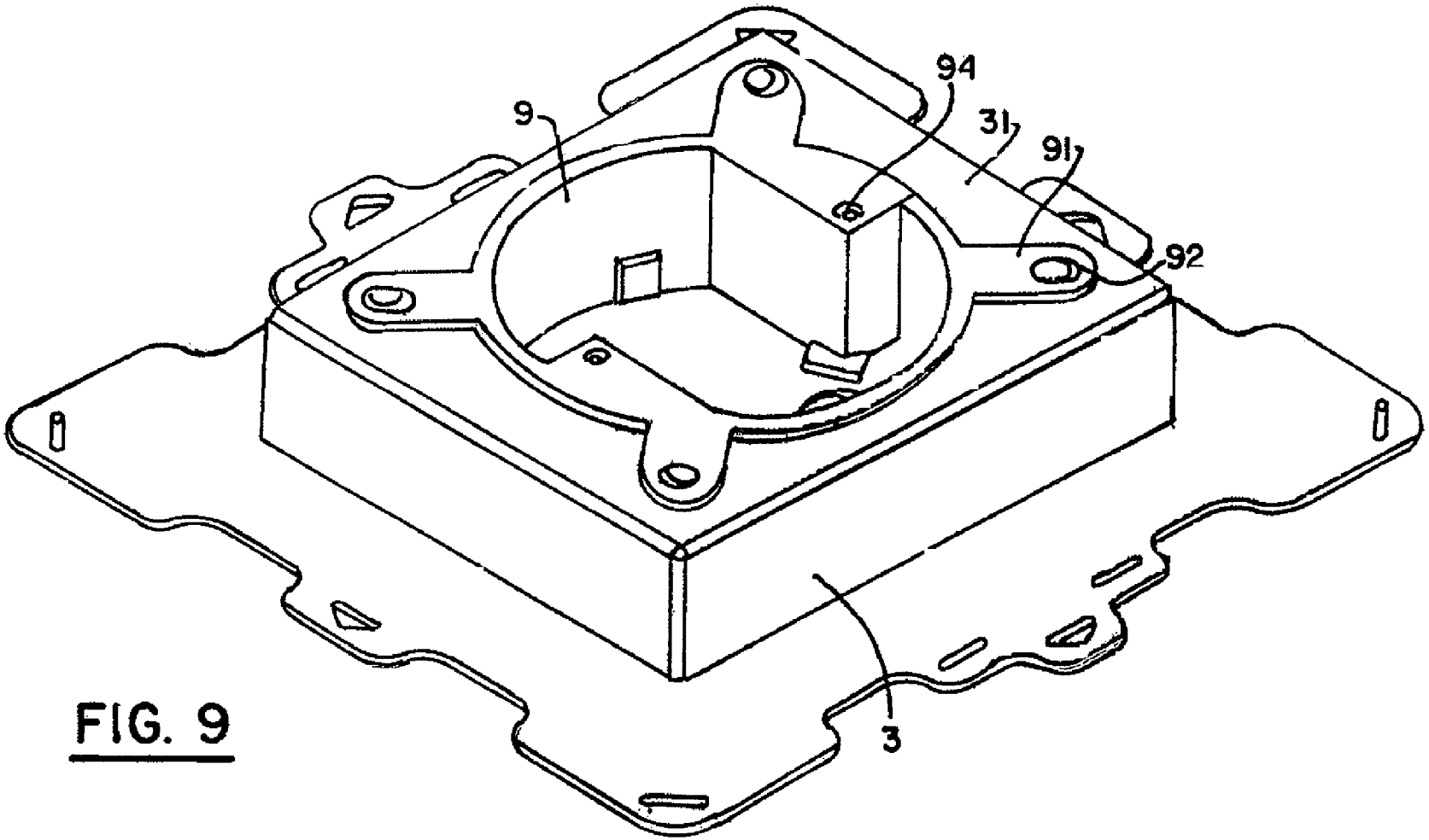
FIG. 9 is a top perspective view of an embodiment in which an electrical box is used with the present invention.
Figure 10:
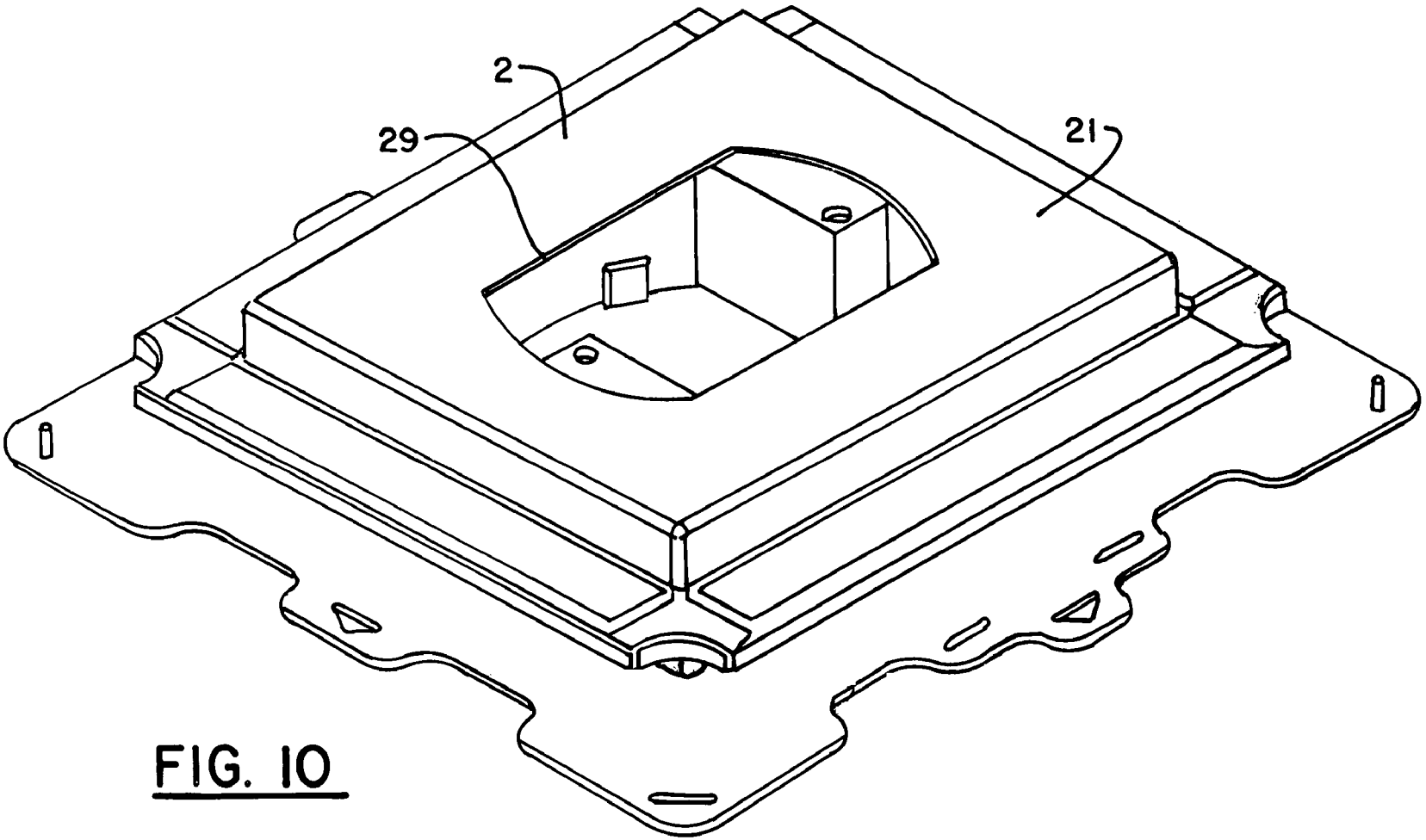
FIG. 10 is a top perspective view of FIG. 9 with the upper cap added.
Figure 11:
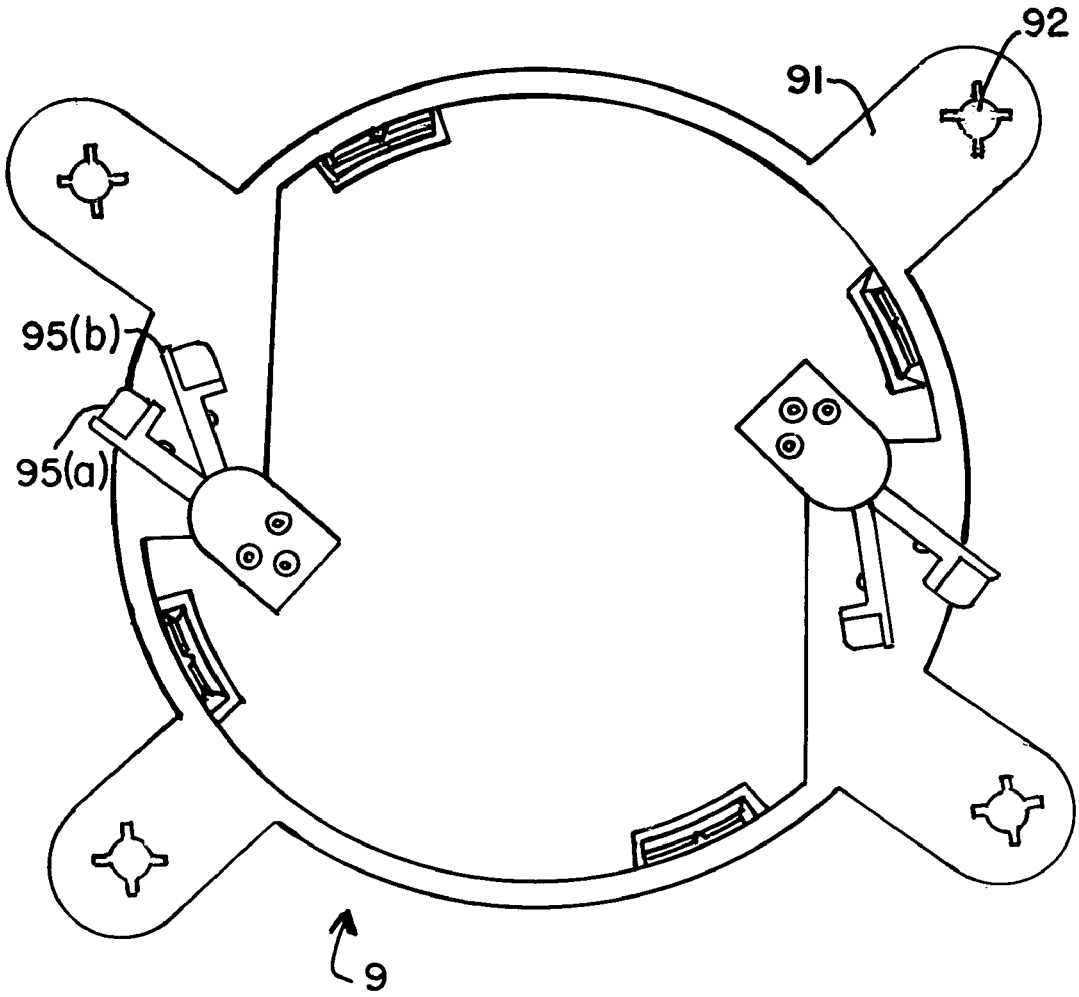
FIG. 11 is a bottom view of the electrical box used in conjunction with the present invention.
Figure 12:
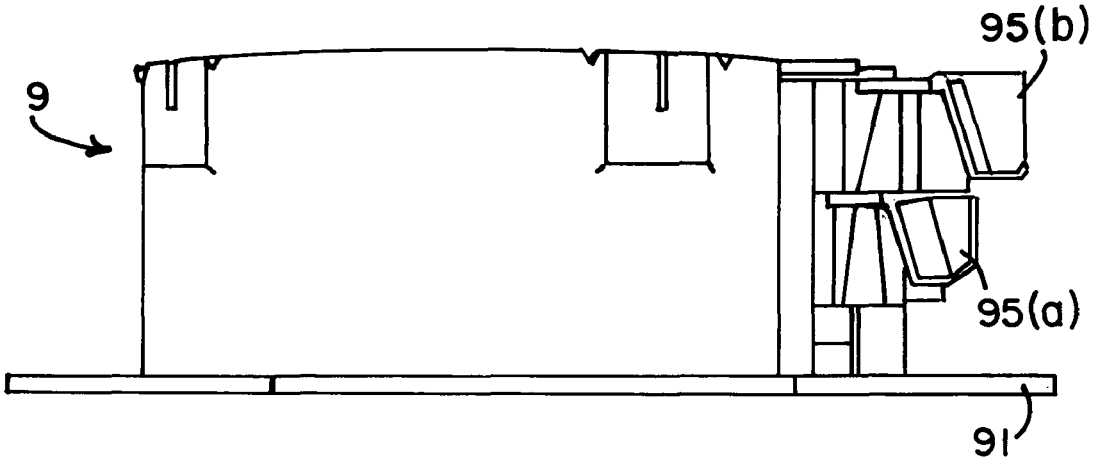
FIG. 12 is a side perspective view of the electrical box used in conjunction with the present invention.

FIG. 10 depicts the arrangement of FIG. 9 with the upper cap 2 positioned as previously described. Any size or shape aperture 29 can be placed in the upper support surface 21, depending upon the size and shape of the fixture to be installed. While the upper holding piece 2 has been depicted as a standard-size cap, other sizes and shapes are possible within the concept of the present invention as long as the connector 25 configuration remains compatible with the common base unit 3.

The electrical box 9 can be adjusted with respect to the standard base unit 3 by being positioned along the length of connectors 25. To make a more secure connection between mounting block assembly 1 and electrical box 9, additional expedients have been added as another embodiment of the present invention. On the bottom of electrical box 9 there are two sets of two mechanical latches 95(*a*) and 95(*b*).

Figure 13:
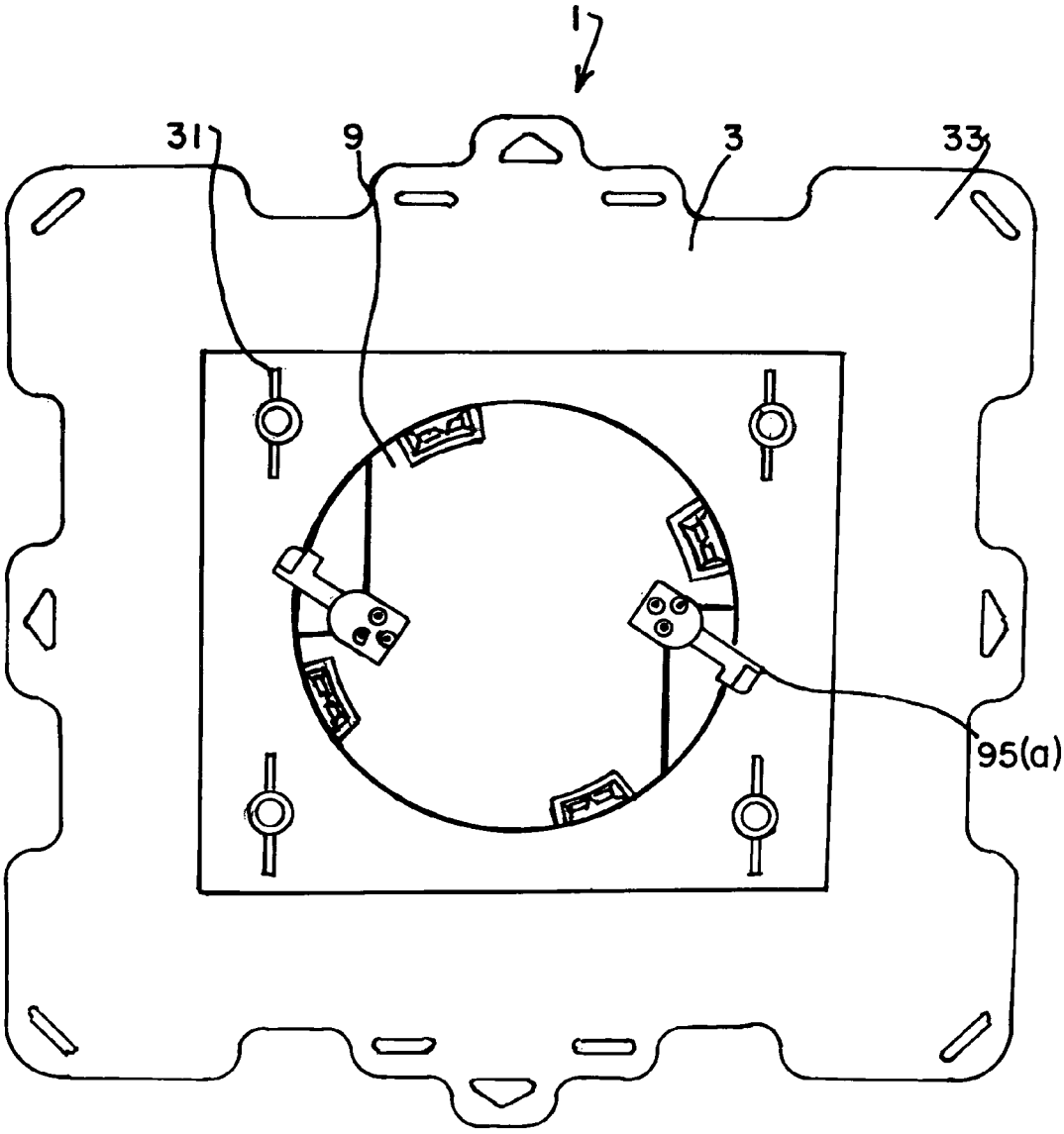
FIG. 13 is a bottom view of the electrical box interfacing with the base section of the present invention.

These latches can be rotated by means of a screw in aperture 94 (FIG. 9) so that one or both of the latches rotates behind a portion of the upper surface 31 of common base unit 3. An example of this connected position is depicted in FIG. 13. The latches 95(*a*), 95(*b*) allow box 9 to be positioned with respect upper surface 31, while maintaining a secure connection between box 9 and base 3.

While a number of the embodiments of the present invention have been made by way of example, the present invention is not limited thereby. Rather, the present invention should be construed to include any and all modifications, variations, permutations, adaptations, derivations and embodiments that would occur to one skilled in this art and comprehending the teachings of the present invention. Accordingly, the present invention should be limited only by the following claims.

I claim:

1. A mounting block system arranged to hold a fixture to a wall having a substrate, said fixture arranged over said substrate, said system comprising:

a) a common base section having at least one integrally formed flange arranged to be positioned against said substrate and a support structure including side walls extending perpendicularly from said flange to an integral upper interface, said upper interface including apertures; and b) an upper cap arranged to fit over said common base and having integrally formed contiguous side walls supporting perpendicularly extending, integrally formed holding flanges and an upper support surface arranged to fit over said common base section, said upper cap having downwardly extending connecting prongs having a corresponding size and configuration as said apertures for mating therewith;

wherein said common base section is configured to interface with a plurality of upper caps of different sizes and configurations, with each of said plurality of upper caps including connecting prongs having the corresponding size and configuration as said apertures for mating therewith.

2. The wall-mounting block system of claim 1, wherein said upper support surface includes four connection prongs substantially parallel to said substrate and arranged to receive said fixture.

3. The wall-mounting block system of claim 2, wherein said common base section includes four apertures.

4. The wall-mounting block system of claim 3, wherein said connecting prongs and said apertures interact as friction-fit devices.

5. The wall-mounting block system of claim 4, wherein said connecting prongs and said apertures are arranged proximate to four corners of said mounting block.

6. The wall-mounting block system of claim 5, wherein said connecting prongs and said apertures effect a uniform connection between said common base section and said upper cap over a plurality of spacings between said common base section and said upper cap.

7. The wall-mounting block system of claim 1, wherein said upper support surface of said upper cap is essentially parallel to said substrate and arranged to receive the fixture.

8. The wall-mounting block system of claim 2, wherein said upper support surface comprises a drilling pattern.

9. The wall-mounting block system of claim 7, wherein said upper interface surface comprises a drilling pattern.

10. The wall-mounting block system of claim 1, wherein said side walls of said upper cap fit closely over said side walls of said common base section.

11. The wall-mounting block system of claim 1, wherein said common base section is made of a material selected from a group consisting of plastic, rubber, metal, nylon, and wood.

12. The wall-mounting block system of claim 1, wherein said common base section is configured to hold said upper cap at an aperture in said wall.

13. The wall-mounting block system of claim 1, further comprising another aperture in said common base section sized and located to accommodate a vent tube; and an upper cap aperture in said upper cap aligned with said another aperture in said common base section.

14. The mounting block system of claim 13, further comprising louvered structure covering said upper cap aperture in said upper cap.

15. The mounting block system of claim 14, wherein said vent tube is metal and attached inside said another aperture of said common base section.

16. The mounting block system of claim 1, further comprising:

an electrical box having pass-through press-fit receptors for receiving said connecting prongs.

17. The mounting block system of claim 16, wherein said electrical box further comprises rotating flanges extendable to fit beneath said upper surface of said common base section.

18. The mounting block system of claim 17, wherein said connecting prongs hold said common base section, said upper cap and said electrical box together.

19. The mounting block system of claim 1 further comprising:

a split tray extending from a top of said sidewalls of said common base section, said split tray forming two contiguous structures having tray sidewalls and tray bottoms, said tray sidewalls being interior to and substantially parallel to said sidewalls of said common base section.

20. The mounting block system of claim 19, wherein said split tray includes said apertures for interfacing with said connecting prongs.

* * * * *